US006534020B1

(12) United States Patent
Byrne

(10) Patent No.: US 6,534,020 B1
(45) Date of Patent: Mar. 18, 2003

(54) FUME RECOVERY METHODS

(75) Inventor: Brian T. Byrne, Chanhassen, MN (US)

(73) Assignee: Garlock Equipment Co., Minneapolis, MN (US)

( * ) Notice: Subject to any disclaimer, the term of this patent is extended or adjusted under 35 U.S.C. 154(b) by 863 days.

(21) Appl. No.: 08/890,471

(22) Filed: Jul. 9, 1997

(51) Int. Cl.[7] ..... F23D 14/00; F23G 7/06; F23M 9/06

(52) U.S. Cl. ..... 422/168; 422/173; 431/5; 431/171; 431/172; 110/203

(58) Field of Search ..... 422/168, 173; 431/5, 171, 172, 202; 110/210, 211, 212, 214, 203; 266/144, 145; 126/343.5 A, 374; 99/330

(56) References Cited

U.S. PATENT DOCUMENTS

| | | | | | |
|---|---|---|---|---|---|
| 2,970,351 | A | | 2/1961 | Rice | 164/254 |
| 3,090,675 | A | * | 5/1963 | Ruff et al. | 422/173 |
| 3,581,782 | A | | 6/1971 | Onufer | 141/59 |
| 3,675,400 | A | | 7/1972 | Kubsch | 55/385 |
| 3,804,079 | A | * | 4/1974 | Schrader | 126/343.5 A |
| 3,844,901 | A | | 10/1974 | Roe et al. | 202/263 |
| 3,880,143 | A | * | 4/1975 | Hart et al. | 126/343.5 A |
| 3,955,236 | A | | 5/1976 | Mekelburg | 15/314 |
| 3,988,421 | A | * | 10/1976 | Rinaldi | 423/210 |
| 4,087,333 | A | | 5/1978 | Naevestad | 202/227 |
| 4,092,095 | A | * | 5/1978 | Straitz, III | 431/202 |
| 4,450,900 | A | | 5/1984 | Nathan | 165/42 |
| 4,512,245 | A | | 4/1985 | Goldman | 98/115.4 |
| 4,563,943 | A | | 1/1986 | Bertelsen | 98/115.1 |
| 4,770,088 | A | | 9/1988 | Kistner | 98/115.2 |
| 4,804,392 | A | | 2/1989 | Spengler | 55/356 |
| 4,865,628 | A | | 9/1989 | Iwanczyk | 55/74 |
| 4,991,532 | A | * | 2/1991 | Locke | 114/211 |
| 5,004,483 | A | | 4/1991 | Eller et al. | 55/20 |
| 5,036,754 | A | | 8/1991 | Simms et al. | 98/115.4 |
| 5,064,451 | A | | 11/1991 | Phillips | 55/74 |
| 5,069,691 | A | | 12/1991 | Travis et al. | 55/126 |
| 5,073,259 | A | | 12/1991 | Solimar | 210/232 |
| 5,160,515 | A | | 11/1992 | Nelson et al. | 55/267 |
| 5,183,646 | A | * | 2/1993 | Anderson et al. | 423/210 |
| 5,191,909 | A | | 3/1993 | Nadeau et al. | 135/93 |
| 5,223,005 | A | | 6/1993 | Avondoglio | 55/96 |
| 5,281,246 | A | | 1/1994 | Ray et al. | 55/302 |
| 5,443,325 | A | | 8/1995 | Simonelli et al. | 404/75.108 |
| 5,591,244 | A | | 1/1997 | Vross et al. | 55/356 |
| 5,620,668 | A | * | 4/1997 | Driscoll et al. | 422/175 |
| 5,833,938 | A | * | 11/1998 | Blazejewski | 422/175 |
| 5,873,919 | A | * | 2/1999 | Vross et al. | 55/315.1 |

OTHER PUBLICATIONS

Reeves Afterburner Jun. 1996.
Roofer Magazine, Feb. 1997, pp. 48, 49, 54, 56 & 57.

* cited by examiner

*Primary Examiner*—Jerry D. Johnson
*Assistant Examiner*—Alexa S. Doroshenk
(74) *Attorney, Agent, or Firm*—Alan Kamrath; Rider, Bennett, Egan & Arundel, LLP

(57) ABSTRACT

Apparatus (10) for recovering fumes from a roofing kettle (12) includes a fan (72) for drawing air from the hollow interior of a housing (20). A conduit (34) extends through the housing front wall (22) and terminates in the hollow interior. A burner assembly (44) is disposed within the conduit (34) for providing a flame within the conduit (34). The housing side wall (30) includes a fresh air intake (78). A flexible metal hose (80) extends between the outer free end of the conduit (34) and the roofing kettle (12). Rotation of the fan (72) causes air to be drawn from the interior of the housing (20) and in turn through the fresh air intake (78), through the conduit (34) and the hose (80) from the interior of the kettle (12), and through the duct (46) and tube (58) of the burner assembly (44). Fumes are thereby drawn from the kettle (12) through the conduit (34) and are burned or otherwise consumed in the conduit (34) so that the emissions from the outlet (76) of the fan (72) are clear and generally free of odor.

9 Claims, 1 Drawing Sheet

FUME RECOVERY METHODS

BACKGROUND

The present invention generally relates to apparatus and methods for recovering fumes, particularly to apparatus and methods for recovering fumes during the application of a heated, waterproofing material to a roof, and specifically to apparatus and methods for recovering and burning fumes from a heated, waterproofing material.

During the installation of many flat roofs, waterproofing material is heated such as in a roofing kettle or like tanker and pumped therefrom onto a roof. To avoid pressure build-up as the result of heating the material and to prevent the creation of a vacuum during pumping, the kettle is vented to the atmosphere. Unfortunately, such venting also allows the escape of fumes to the atmosphere, which fumes are extremely repugnant to many. In fact, many roofing contracts, especially for schools, hospitals, residential areas and the like, require that the fumes from at least the roofing kettle be recovered and not be allowed to escape to the atmosphere.

Prior attempts to solve this problem in the field of roofing material application included the use of filtration units such as disclosed in U.S. Pat. No. 5,591,244. Such units are undesirable for several reasons. First, such filter units require a large initial capital investment. Further, operation of such units causes the filters thereof to become plugged requiring replacement. In addition to the cost of the filters and their installation, disposal costs can be large as often such plugged filters are classified as hazardous waste. Additionally, air is required to be drawn through the filters even as material filtered from the air collects on the filter. Thus, large fans are required, which require considerable energy input and are quite noisy. Also, considerable heat is withdrawn from the kettle with the air and thereby increasing the amount of heat which must be supplied to the material by the kettle. Additionally, such filter units are quite large and often are required to be transported to the job site by a flat bed truck.

Another attempt to solve this problem has been the use of an afterburner such as manufactured by Reeves Roofing Equipment Co., Inc. of Helotes, Tex. 78023. Generally, such an afterburner includes a vertical chimney upstanding from a roofing kettle lid or cover. A burner was positioned in the chimney. The heat from the burner causes air to rise in the chimney and be drawn from the interior of the roofing kettle. The fumes passing through the chimney and past the burner are burned to eliminate visible smoke and odor. Although fire screens are provided, fire and explosions are of concern because the burner in the afterburner is in close proximity to the material in the roofing kettle and there is no provision for stopping gas flow to the burner in the afterburner in the event that the burner flame does not start or goes out. Also, as air flow is dependent solely upon the chimney effect of the afterburner, fumes tend to escape from the kettle around the lid cover and other locations even when the afterburner is operational. Additionally, operation of afterburners is limited to roofing kettles and the like and generally is not applicable for use at other locations such as on the roof itself.

Thus, a need continues to exist for apparatus for recovering fumes from a roofing kettle or the like which overcomes the disadvantages and deficiencies of prior approaches at solving this problem.

SUMMARY

The present invention solves this need and other problems in the field of fume recovery especially for the roofing industry by providing, in the preferred form, apparatus and methods for drawing air in fluid communication with the fumes of a container of heated material through a conduit and past a burner assembly in the conduit, with the flame of the burner burning or otherwise consuming the fumes of the container.

In most preferred aspects, the conduit is horizontally arranged and terminates in the hollow interior of a housing so that fresh air can also be drawn from the hollow interior in addition to the air drawn through the conduit, with fresh air also being provided to the burner assembly inside of the conduit.

It is thus an object of the present invention to provide novel methods and apparatus for recovering fumes.

It is further an object of the present invention to provide such novel fume recovery methods and apparatus especially adapted for mobile applications between various job sites and especially in the roofing industry.

It is further an object of the present invention to provide such novel fume recovery methods and apparatus having relatively low air flow rates while preventing the tendency of fumes to escape from the source during operation.

It is further an object of the present invention to provide such novel fume recovery methods and apparatus having reduced capital costs.

It is further an object of the present invention to provide such novel fume recovery methods and apparatus having reduced operational costs.

It is further an object of the present invention to provide such novel fume recovery methods and apparatus which do not require disposal of collected material.

It is further an object of the present invention to provide such novel fume recovery methods and apparatus having reduced operational noise.

It is further an object of the present invention to provide such novel fume recovery methods and apparatus having reduced risk of igniting the fumes or the material source of the fumes.

It is further an object of the present invention to provide such novel fume recovery methods and apparatus of a minimal size which is easy to handle and transport.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
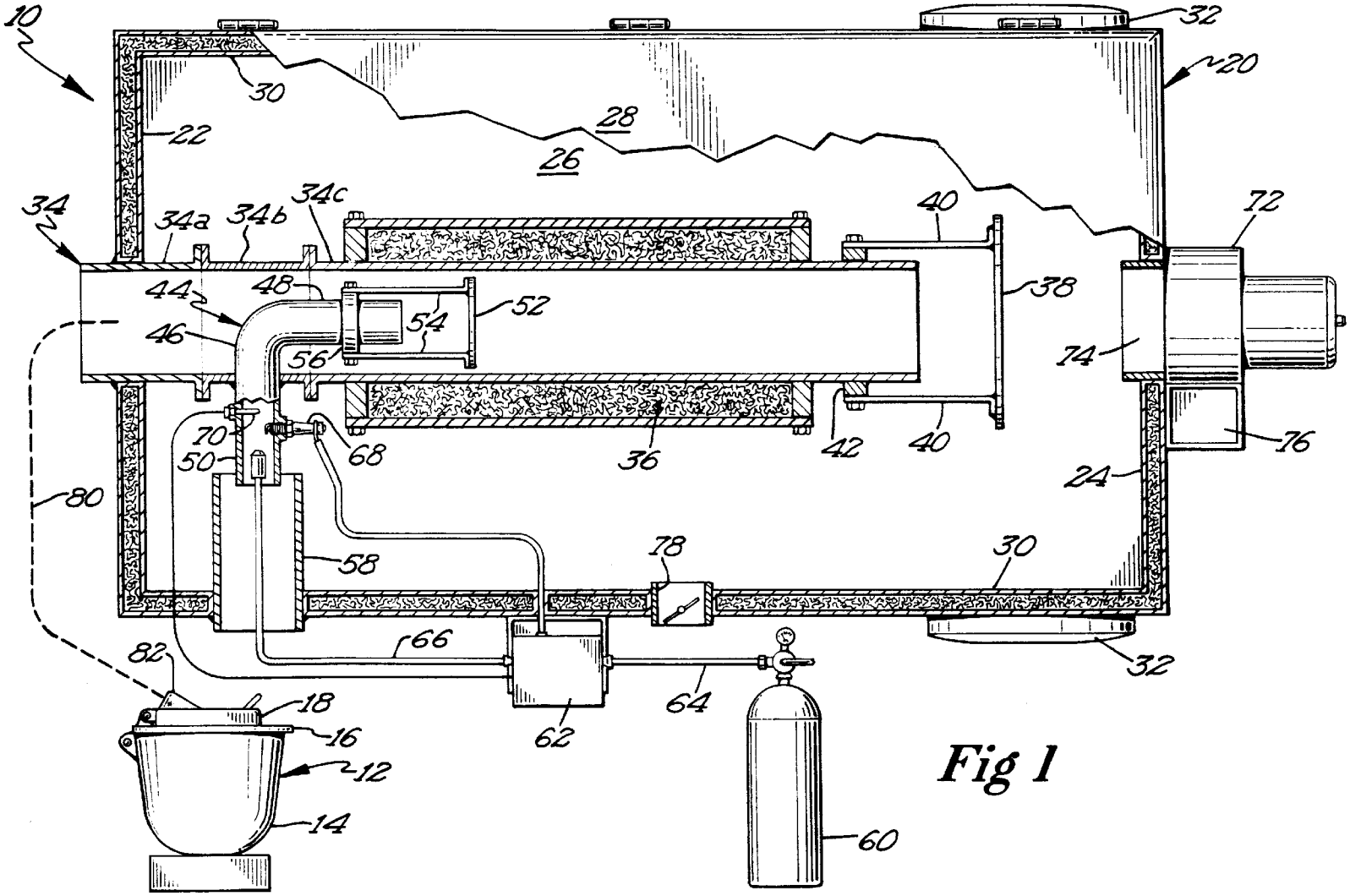
FIG. 1 shows a diagrammatic, top plan view of a fume recovery apparatus according to the preferred teachings of the present invention.

The figure is drawn for ease of explanation of the basic teachings of the present invention only; the extensions of the figure with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the drawings, the same numerals designate the same or similar parts. Furthermore, when the terms "top", "bottom", "first", "second", "inside", "outside", "front", "back", "outer", "inner", "upper", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION

An apparatus for recovering fumes according to the preferred teachings of the present invention is shown in the drawings and generally designated 10. In the most preferred form shown, apparatus 10 is utilized to recover fumes from a roofing kettle 12. Kettle 12 can be of any design such as of the type disclosed in U.S. Pat. No. 5,575,272. Generally, kettle 12 includes a vat or similar container 14 in which asphalt or other similar water-proofing roofing material is heated by any suitable means. A vat cover 16 encloses the open top of vat 14 and can include one or more vat lids 18 which can be raised and lowered for the introduction of hard kegs of asphalt for melting. After melting, the liquid asphalt can be pumped from vat 14 to the roof by suitable pumping mechanisms.

Generally, apparatus 10 includes an insulated housing 20 having a front wall 22, a back wall 24, a bottom wall 26, a top wall 28, and first and second side walls 30 defining a hollow interior. In the most preferred form, access is provided to the hollow interior of housing 20 by hinging top wall 28 to second side wall 30. Housing 20 in the preferred form is movably supported such as by wheels 32.

A conduit 34 extends generally horizontally through front wall 22 into the hollow interior of housing 20 and towards but spaced from back wall 24 parallel to and intermediate bottom and top walls 26 and 28 and parallel to and intermediate side walls 30. Thus, the free, downstream end of conduit 34 is located in and in fluid communication with the hollow interior of housing 20. In the most preferred form, conduit 34 includes a first inlet portion 34*a* integrally formed with front wall 22, a second, interconnection portion 34*b*, and a third, combustion chamber portion 34*c*. Interconnection portion 34*b* is located intermediate and is removably connected to portions 34*a* and 34*c* such as by mounting flanges. The outer surface of combustion chamber portion 34*c* in the preferred form includes suitable insulation 36.

A circular baffle plate 38 having a diameter slightly larger than the diameter of conduit 34 and considerably smaller than the spacing between walls 26 and 28 and between walls 30 is supported in a spaced relation from the free, downstream end of conduit 34. Specifically, in the preferred form, first and second legs 40 are provided having first ends suitably secured such as by welding to baffle plate 38 and opposite, second ends suitably secured to a collar 42 which is removably secured to conduit 34.

Apparatus 10 further includes a burner assembly 44 disposed within conduit 34 for providing a flame in conduit 34. Generally, burner assembly 44 includes an L-shaped duct 46 mounted to interconnection portion 34*b*. In particular, duct 46 includes a first leg 50 integrally formed and extending generally horizontally through interconnection portion 34*b*. Duct 46 further includes a second leg 48 extending generally perpendicular to first leg 50 and generally horizontally and concentrically inside conduit 34. In particular, leg 48 extends beyond the downstream end of portion 34*b* and into portion 34*c*, is with the free end of leg 48 located spaced from the downstream end of portion 34*c* and adjacent the upstream end of portion 34*c*. The diameter of duct 46 is considerably less than the diameter of conduit 34 and in the preferred form is less than one-half of the diameter of conduit 34.

A circular baffle plate 52 having a diameter slightly less than the diameter of conduit 34 and larger than the diameter of duct 46 is supported in conduit 34 in a spaced relation from the free, downstream end of duct 46. Specifically, in the preferred form, first and second legs 54 are provided having first ends suitably secured such as by welding to baffle plate 52 and opposite ends suitably secured to a collar 56 which is removably secured to duct 46.

Burner assembly 44 further includes a tube 58 integrally formed with and extending generally horizontally through first side wall 30. Tube 58 has a diameter slightly greater than the diameter of duct 46. The free, upstream end of leg 50 extends into tube 58 and beyond the inner, free end of tube 58.

Burner assembly 44 further includes a source 60 of fuel such as LP gas (liquid propane) in fluid communication with a control box 62 by a fuel line 64. A fuel line 66 extends from control box 62 into and through tube 58 and terminates in a nozzle located in leg 50 of duct 46. It should be noted that air is allowed to communicate inside of burner assembly 44 through tube 58 and into duct 46 and around, fuel line 66 and the nozzle thereof. A spark igniter or spark plug 68 or similar ignition device is positioned in leg 50 of duct 46 upstream of the nozzle of fuel line 66 for igniting the fuel exiting from the nozzle of fuel line 66. A flame sensor 70 or similar device for detecting that the fuel exiting the nozzle of fuel line 66 is burning is positioned in leg 50 of duct 46 upstream of spark plug 68. It should be appreciated that a source of power such as a battery or provisions for plugging into an electrical outlet, not shown, may be necessary for operation of control box 62, spark plug 68, and flame sensor 70.

In the preferred form, control box 62, spark plug 68 and flame sensor 70 are of the form disclosed in U.S. Pat. No. 5,941,236 which is hereby incorporated herein by reference. In particular, control box 62 includes suitable circuitry to open a solenoid valve to an open condition to allow flow of fuel from source 60 and through fuel lines 64 and 66 to the nozzle in duct 46. After a time delay of a few seconds, for example about four seconds, for fuel gas to flow to duct 46, a current is applied to spark plug 68 to produce a spark which ignites the fuel gas mixture. The flame extends through duct 46 and engages baffle plate 52. Flame thus passes flame sensor 70 which senses the flame. If a flame is sensed by flame sensor 70, control box 62 maintains the solenoid valve open allowing communication between fuel lines 64 and 66. If a flame is not sensed by flame sensor 70, control box 62 de-energizes the solenoid valve preventing communication between fuel lines 64 and 66. It should be noted that the circuitry of control box 62 includes suitable provisions for allowing the initial communication of fuel lines 64 and 66 and the production of a spark by plug 68 even though flame is not sensed by sensor 70 to start operation and for performing further attempts to initiate ignition if not occurring after the first and second attempts when the on-off switch is initially turned to its "on" position. It should be noted that spark plug 68 is not continually activated during operation of apparatus 10, but is only activated during attempts to initiate ignition.

Apparatus 10 further includes provisions for drawing air from the hollow interior of housing 20. In the preferred form, a fan 72 is provided having an inlet 74 integrally formed with and extending through back wall 24 and an outlet 76 located outside of housing 20. Fan 72 is suitably powered such as by a gasoline engine or an electric motor. In addition, housing 20 includes a fresh air intake 78 allowing air communication from outside of housing 20 to the hollow interior thereof. In the preferred form, intake 78 is integrally formed in and extends through first side wall 30 and spaced upstream of the free, downstream end of conduit 34 and can include an adjustable valve plate for adjusting flow rates therethrough.

Apparatus 10 is removably attached to kettle 12 in the form shown by a flexible metal hose 80 extending from the free, upstream end of conduit 34 positioned outside of the hollow interior of housing 20 to a suitable plenum 82 positioned in cover 16 of kettle 12. Thus, the interior of vat 14 is in removable fluid communication with the interior of housing 20 by hose 80.

Now that the basic construction of apparatus 10 according to the preferred teachings of the present invention has been set forth, the operation and some of the advantages of apparatus 10 can be explained and appreciated. Specifically, after hose 80 is attached between kettle 12 and apparatus 10, the source of power for fan 72 is started to rotate fan 72. Rotation of fan 72 creates suction in the hollow interior of housing 20 drawing air from the interior of vat 14 through conduit 34 and hose 80 creating negative pressure in kettle 12, drawing air through duct 46 and tube 58, and also drawing air through intake 78. The on-off switch of control box 62 is manually moved to its "on" position to supply and ignite the fuel in a manner as previously set forth. The resulting flame extends from duct 46 and against baffle plate 52. Due to the negative pressure inside of kettle 12, fumes are drawn from kettle 12, through hose 80, and into conduit 34 where they are drawn across the flame at baffle plate 52 and downstream of baffle plate 52. A combustion chamber is formed in conduit 34 downstream of baffle plate 52 which is typically at a temperature of about 1400–1500° F. (760°–815° C.). Thus, as the fumes from kettle 12 are drawn into conduit 34 and pass through the flames and into the combustion chamber of conduit 34, they are burned or otherwise consumed so that the emissions from outlet 76 of fan 72 are clear and generally free of odor. It can be appreciated that baffle plate 38 helps to control flame spread and to control the temperature in the combustion chamber of conduit 34. In this regard, maximum efficiency of operation of apparatus 10 occurs when the combustion chamber of conduit 34 reaches its desired operating temperature after start-up.

It should then be appreciated that fan 72 according to the teachings of the present invention has relatively low air flow rates. Specifically, as the air is not drawn through filters, air flow rates can be relatively low. Specifically, the capital costs are reduced for smaller size fans 72, and the operational costs and noise are similarly reduced for smaller fans 72. Additionally, less heat is drawn from the material of kettle 12 at reduced air flow rates so that the operational heating costs of kettle 12 are not significantly increased. Further, intake 78 allows for fresh air to be drawn into the hollow interior of housing 20 by fan 72 in a mixture of about 2½ parts of fresh air to about one part air drawn from kettle 12 so that the air drawn from kettle 12 is minimized. However, it should be appreciated that the air drawn from kettle 12 should be sufficient so that fumes do not have a tendency to escape from kettle 12 around cover 16, lids 18 and other locations. In the preferred form, air drawn through hose 80 and conduit 34 is in the order of 150 cubic feet (4¼ cubic meters) per minute whereas the air drawn through intake 78 is in the order of 360 cubic feet (10.2 cubic meters) per minute.

Additionally, the risk of burner assembly 44 igniting the fumes or the material inside kettle 12 is clearly minimized. Specifically, the flame produced by burner assembly 44 is at a remote location from the interior of kettle 12 and the flame is directed away from the interior of kettle 12 by leg 48 of duct 46 and is drawn away from the interior of kettle 12 by operation of fan 72. Also, the fumes of kettle 12 are drawn away from the interior of kettle 12 and are combusted at a remote location from the interior of kettle 12.

The only consumable of apparatus 10 is the fuel of source 60 which in the most preferred form is of the same type utilized for heating the material in kettle 12 and which is supplied at 10 psi (0.7 kilograms per square centimeter) (aside from the energy requirements for operation of control box 62 and fan 72). The cost of the fuel is considerably less than the cost of filters, and there are no disposal problems such as arise in disposing of used filters. Additionally, the labor required in removing and replacing filters is completely eliminated.

Additionally, the size of apparatus 10 according to the teachings of the present invention is relatively small and considerably smaller than prior filter units. In particular, apparatus 10 in the preferred form is of a size to fit in the box of the pick-up or similar truck utilized to pull kettle 12. Thus, it is easily transported to the desired sites separate from kettle 12 and can be operated with different kettles 12 where and when necessary. In this regard, due to its relatively small size, apparatus 10 could be lifted up to the roof surface or repair site for recovering fumes as the material is being pumped from kettle 12 into mobile carriers on the roof. It can be appreciated that apparatus 10 can be sized according to the desired air flow from the source of fumes such that for roof top operation, the size of apparatus 10 can be further minimized for ease of handling.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Method for recovering fumes from a container of roofing material comprising rotating a fan to draw air from the inside of the container of roofing material for passing through a conduit in fluid communication with the container of roofing material; and providing a flame within the conduit, with the fumes passing through the conduit with the air drawn from inside of the container of roofing material being burned or consumed by the flame.

2. The fume recovery method of claim 1 further comprising: providing a housing having a hollow interior, with the conduit extending into the hollow interior and having a first free end located in and in fluid communication with the hollow interior of the housing.

3. The fume recovery method of claim 2 further comprising: providing a fresh air intake into the hollow interior of the housing, wherein a first portion of a volume of the air within the hollow interior of the housing has passed through the conduit and a second portion of the volume of the air within the hollow interior of the housing has passed through the fresh air intake.

4. The fume recovery method of claim 2 wherein the flame is provided within the conduit which is horizontally arranged.

5. The fume recovery method of claim 2 wherein the fan is located outside of the hollow interior of the draws air from the hollow interior of the housing and having an inlet in communication with the hollow interior of the housing.

6. The fume recovery method of claim 2 wherein the flame is provided by providing a fuel to a burner assembly disposed within the conduit; igniting the fuel while the air is passing through the conduit; and continuing to provide fuel to the burner assembly after the fuel is ignited and while the air is passing through the conduit.

7. The fume recovery method of claim 2 further comprising: providing a flexible metal hose, with the conduit having a second free end located outside of the hollow interior of the housing, with the metal hose being secured to the second free end of the conduit; and removably connecting the metal hose to and in fluid communication with the container of roofing material.

8. The fume recovery method of claim 1 wherein the rotation of the fan draws air from inside of the conduit in fluid communication with the container of roofing material.

9. The fume recovery method of claim 1 recovery wherein the fan is rotated by a gasoline engine.

* * * * *

UNITED STATES PATENT AND TRADEMARK OFFICE

CERTIFICATE OF CORRECTION

PATENT NO. : 6,534,020 B1
DATED : March 18, 2003
INVENTOR(S) : Brian T. Byrne

It is certified that error appears in the above-identified patent and that said Letters Patent is hereby corrected as shown below:

Column 4,
Line 24, delete “around, fuel” and substitute therefor -- around fuel --.

Column 7,
Line 2, after “interior of the” insert -- housing and --.

Column 8,
Line 9, delete “claim 1 recovery” and substitute therefor -- claim 1 --.

Signed and Sealed this

Twentieth Day of May, 2003

JAMES E. ROGAN
*Director of the United States Patent and Trademark Office*